United States Patent [19]

Wilhelm, Jr.

[11] Patent Number: 4,531,509

[45] Date of Patent: Jul. 30, 1985

[54] AUTOMATIC WATER HEATER SYSTEM

[76] Inventor: Robert O. Wilhelm, Jr., 3720 Wayne Rd., Munhall, Pa. 15120

[21] Appl. No.: 494,980

[22] Filed: May 11, 1983

[51] Int. Cl.[3] ..... F24H 1/00

[52] U.S. Cl. ..... 126/362; 122/17; 165/DIG. 18; 126/365

[58] Field of Search ..... 237/19; 165/DIG. 18; 126/364, 365, 362, 361; 122/17, 16, 18, 14

[56] References Cited

U.S. PATENT DOCUMENTS

| | | | |
|---|---|---|---|
| 1,961,231 | 6/1934 | Maier | 122/17 |
| 2,506,120 | 5/1950 | Turner | 122/17 |
| 4,216,903 | 8/1980 | Giuffre | 165/DIG. 12 |

*Primary Examiner*—Henry Bennett

*Attorney, Agent, or Firm*—William J. Ruano

[57] ABSTRACT

An automatic water heater system having, contained in a tank, a plurality of vertically extending spiral flame tubes surrounded by substantially vertically extending heat tubes which join the top ends of the spiral flame tubes to form a common exhaust outlet for both sets of tubes, thereby greatly increasing the surface area contact between the water and transfer medium. The heat tubes are especially designed to provide an outlet drain for possible condensation that can develop so as not to drain out through the flame tubes and onto the flame. A heat trap, to capture heat from the hot flue gases otherwise lost by normal passage up through the chimney, may be provided, as well as a blower in the exhaust outlet. The above described structure can be assembled either as a combination heating and storage tank in a single unit, or as a separate component heating unit connected to the storage tank located alongside it.

4 Claims, 10 Drawing Figures

AUTOMATIC WATER HEATER SYSTEM

This invention relates to an automatic water heater system, particularly for household use.

An outstanding disadvantage of existing automatic water heater systems is that they generally include essentially straight line tubes which may include such things as fins or baffles which provide a minimum surface area contact between the water and transfer medium thereby allowing a significant amount of heat to excape via flue gases moving up the exhaust and out the chimney, hence, lowering the efficiency of the heater.

An object of the present invention is to overcome the above-named disadvantage by providing a novel automatic water heater system having substantially increased efficiency over conventional units.

Another object of the invention is to provide a novel tube assembly for effecting increased efficiency as well as to prevent condensation from draining, into the heater flames.

Another object of the invention is to provide a novel heat trap which can be used for said automatic water heater system, existing conventional automatic water heating systems, as well as other systems where heat can be entrapped that would otherwise be lost via flue gases moving up the exhaust and out the chimney.

Still, another object of the invention is to provide various arrangements and combinations in order to carry out the above-named objects.

Other objects of the invention will become more apparent from the following description taken along with the accompanying drawings, wherein.

An object of the present invention is to provide a novel automatic hot water system that allows for simplified fabrication and less ultimate consumer maintenance.

Figure 1:
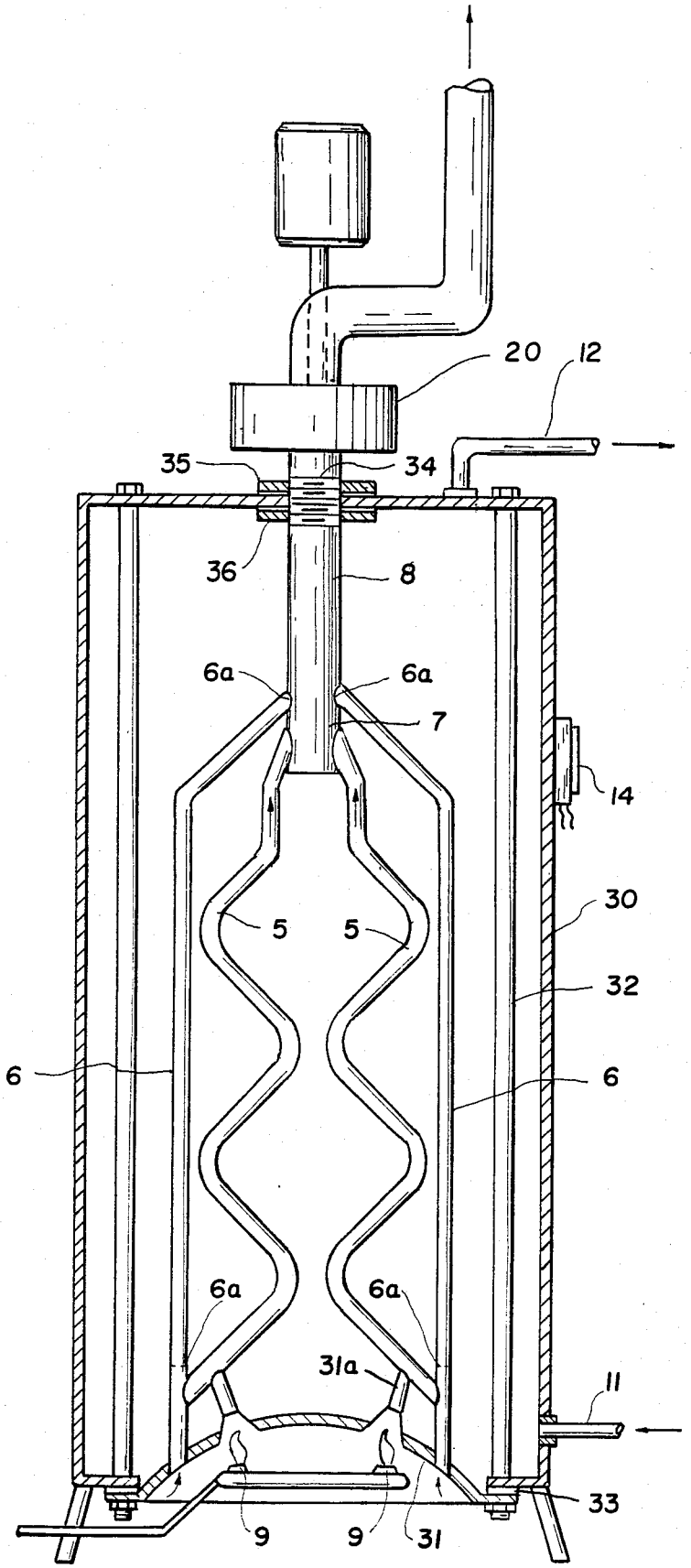
FIG. 1 is a vertical cross sectional view of one form of the invention.
Figure 2:
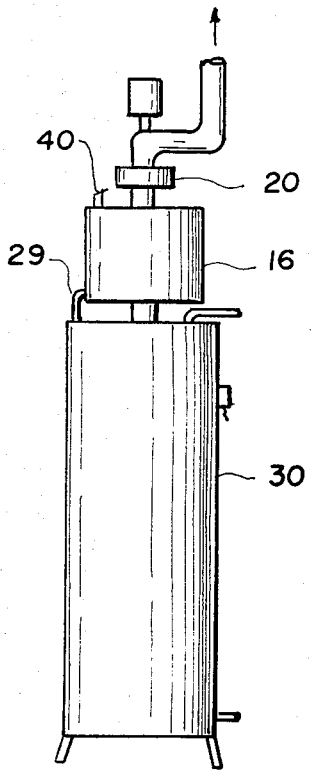
FIG. 2 is an elevational view, in reduced scale, of the construction shown in Fig. 1 with an additional trap 16.

FIG. 1 and 2 show a system which consists of a single tank 30 which can be heavily insulated with suitable materials, with a unique heating and exhaust system designed for the heating and storing of water. A bowed copper heat plate 31 attached to and forming a significant portion of the bottom of the tank 30, said plate being held in place by tie rods 32 or other fastening means. Integrated with this plate are multiple spiral flame tubes 5 and heat tubes 6. These tubes rise through the tank in a serpentine fashion a shown and culminate in a common gallery 7 and, finally, into a common flue 8 before exiting the tank 30. The flue pipe 8 has a threaded outer portion 34 and is engaged by a threaded collar 35 which tightens against the flange 36, which is a part of the flue pipe 8, to form a water-tight seal at the top of the tank. This common flue can be connected to the tank by other means than is described herein, such that a water-tight seal and integrity of the tank is maintained.

The heat source which can be natural gas, propane, oil, or other suitable fuels, is shown being introduced by a burner jet 9 located directly under the flame tubes 5, but may include other similar mechanisms for producing flames.

The function of the present invention is to provide maximum heat transfer from hot gases developed from the heat source to the water and increase efficiency over conventional units. This is accomplished by increasing surface area contact between the water and transfer medium over conventional systems by the use of a combination of several flame tubes 5 and heat tubes 6 with small diameters, rather than essentially one large diameter tube, allowing the hot flue gases to have significantly greater contact with the transfer medium (tubes) via a serpentine route rather than essentially straight line tubes with fins or baffles, and, finally, to capture any heat generated around the heat source which would normally escape with a plurality of heat tubes 6 surrounding the flame tubes 5. The heat tubes 6 are specially designed to provide an outlet drain for possible condensation which can develop so that it cannot drain out through flame tubes 5 and onto the flames, as shown in FIG. 1. (Refer to overlapping lip design shown in FIG. 1, 31*a*).

The tank 30 has normal cold water inlet 11 and hot water exits 12 as shown, thermostat 14 for temperature control and safety unit 10, and pressure relief valve 40.

It should be noted that this design does not preclude the use of other devices such as a pilotless heat source, automatic flue dampeners, temperature control timers for (non-peak) usage, etc., which may further improve the efficiency of said system.

The heating unit including flame tubes 5 and heat tubes 6, comprise a single unit which may be fabricated and then inserted into a prefabricated tank through the bottom and then attached at the top and bottom by tie rods 32, 33 as shown. This allows ease of lining the tank because of large opening that would not normally be present in conventional systems. Gasket elements are provided between sealing flanges 35, 36, —35 being screw-threaded to exhaust pipe 8.

FIG. 1 may or may not include blower 20 attachment to flue 8 which may or may not be desired for the final unit.

Figure 6:
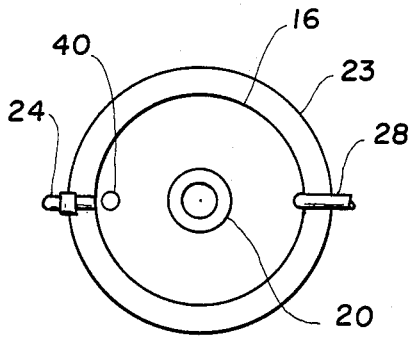
FIG. 6 is a top view of the modification shown in FIG. 5.
Figure 5:
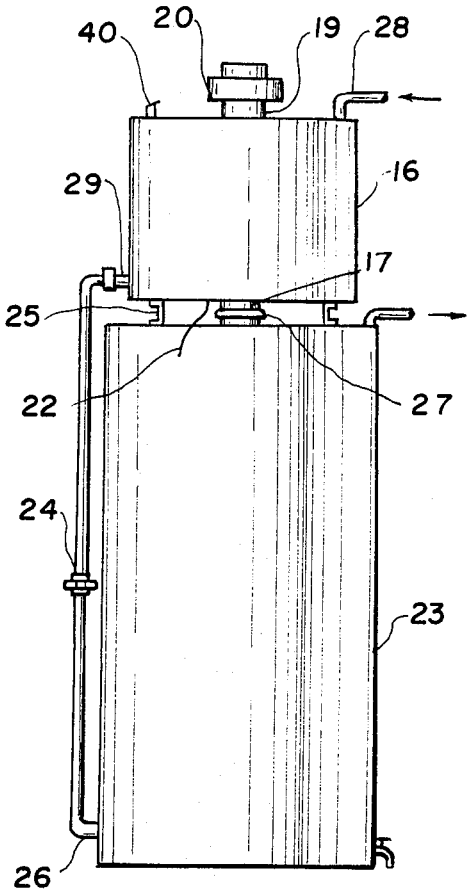
FIG. 5 is an elevational view of a modification.
Figure 8:
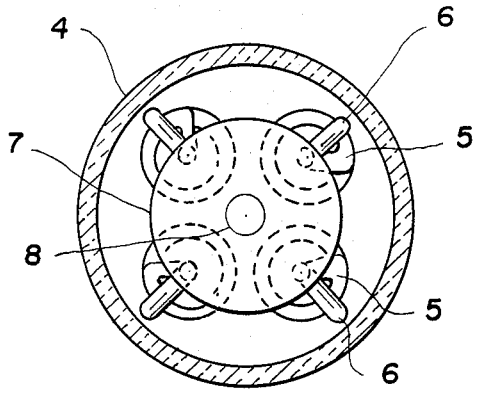
FIG. 8 is a sectional view taken along line 8—8 of FIG. 7.

FIGS. 5 and 6 illustrate a heat trap designed to capture heat from hot flue gases which would otherwise be lost by normal passage up through the chimney. This heat trap can be attached to existing conventional gas water heater tanks as well as the heating system described in FIG. 1.

The trap consists of tank 15 with suitable insulation 16. At the bottom of this tank 15 is an exhaust inlet pipe 17 which can be connected by suitable means to a flue exhaust from a conventional gas water heater (illustrated in FIG. 5) or to the flue pipe 8 of the heating system described in FIG. 1. This inlet pipe 17 branches off into heat tubes 18, which, in turn, enter a common exhaust pipe 19. This exhaust gas flow can be increased by the incorporation of an electrically powered blower 20 to increase flow if desired to force flue gases at a constant rate to the chimney and create a turbulence of air at the heat source for "hotter" flames.

This heat trap is designed to receive the first shot of cold water at inlet 28 whenever water is withdrawn from the main system and will, in turn, deliver the first shot of "partially" heated water through pipes 24, 29 to the main tank below. This design maximizes heat transfer because the heat trap isolates a goodly portion of water at all times during normal tank operation which will be significantly lower in temperature than the main storage tank. This colder water will allow much more heat transfer than its main tank counterpart and "trap" heat which would normally be carried away with flue gases out the chimney. Any system where water is heated to a controlled high temperature may be able to improve efficiency by trapping normally lost heat with this method. In other words, heating systems such as swimming pool heaters, hot tubs, and others, can make use of this design for a heat trap. It should be noted that this heat trap can be structured other than as illustrated herein, such that the described method of entrapping normally lost heat from exhaust flue gases remains intact. Such factors as available space, etc. may dictate the use of various designs such as "flatter" tankage, "angled" heat tubes, etc. to meet needed parameters while maintaining original concept.

The heat trap shown is equipped with a suitable pressure relief valve 40 for safety. Also, condensation which may develop can be removed normally via an overlapping lip design for the flue inlet pipe 17 of the trap and the flue exhaust pipe of the main system using a design similar to that covered in FIG. 1 for the flame tubes and the heat tubes such that the condensate will flow to the bottom of the overlapping flue inlet 17 and be captured and drained down the side of the tank into a suitable container rather than flow down the main tank flue system. Other mechanisms for possible condensate drainage can be used. One such method is described in FIG. 4.

Figure 4:
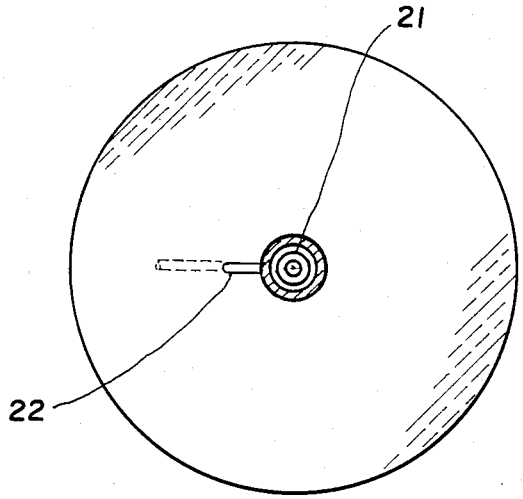
FIG. 4 is a cross sectional view taken along line 4—4 of FIG. 3.
Figure 3:
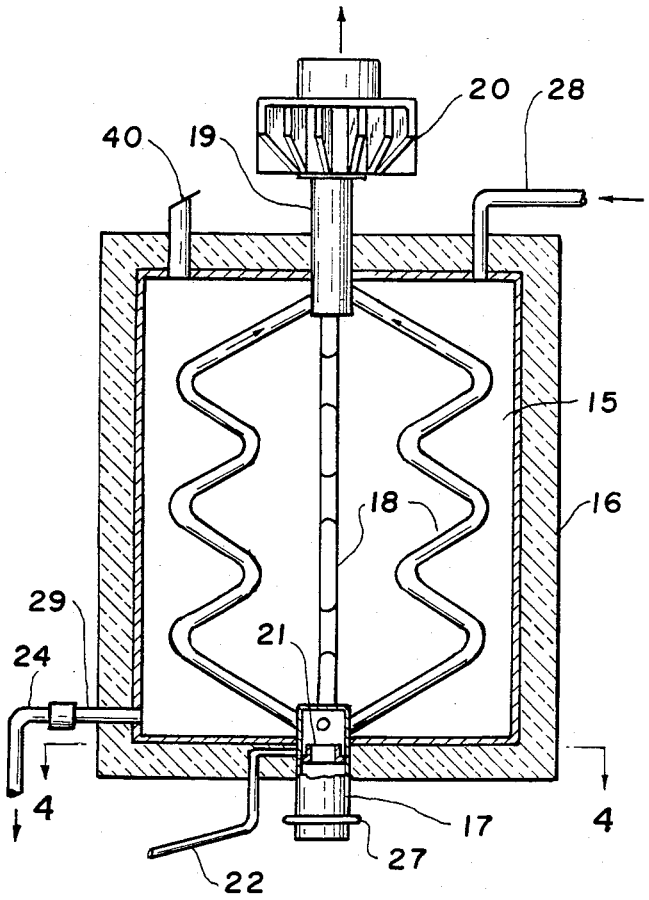
FIG. 3 is an enlarged vertical cross sectional view of the trap 16 as shown in FIG. 3.

FIG. 4 is a cross section of FIG. 3 taken along lines 4—4 of FIG. 3 showing a condensate collector 21 which conducts condensed water vapor out of the heat system through pipe 22, said pipe emptying into a floor drain or suitable container. This design incorporates the use of a "donut" fitting fully surrounding and contacting the flue surface and allowing condensate to drain through an outlet tube.

FIG. 5 illustrates a heat trap attached to a conventional gas fired water heater 23 with the heat trap attached to it by brackets 25, also showing a connecting pipe and union 24 which conveys the partially warmed water to the cold water inlet 26 of the conventional water heater. A clamp 27 tightly hold the flue pipe of the conventional water heater inside the exhaust inlet 17 of the heat trap unit.

FIG. 6 shows a top plan view of FIG. 5 showing the cold water inlet 28 of the heat trap and the outlet pipe 29 of the heat trap unit.

Figure 7:
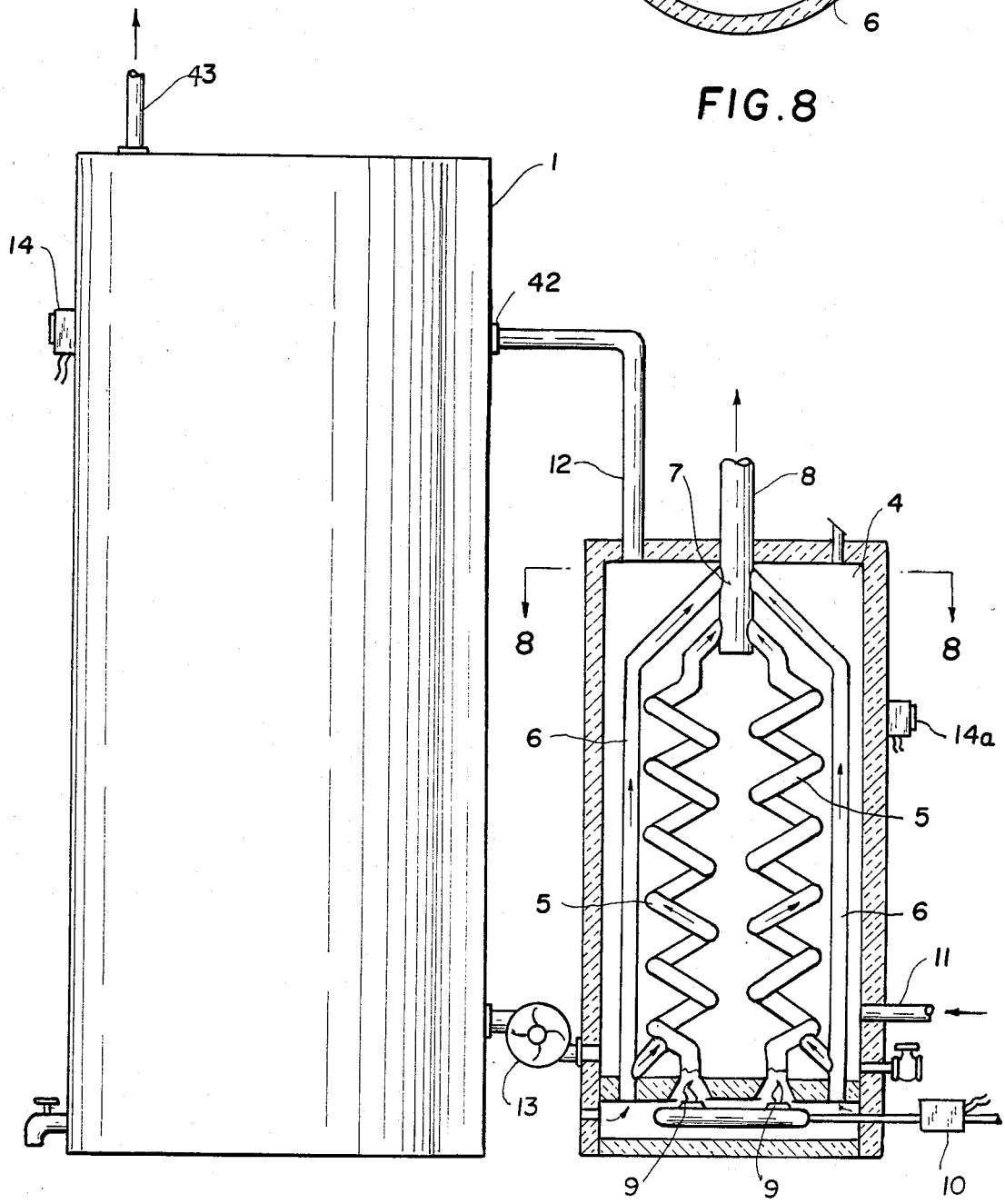
FIG. 7 is an elevational view partly in section of a further modification.
Figure 9:
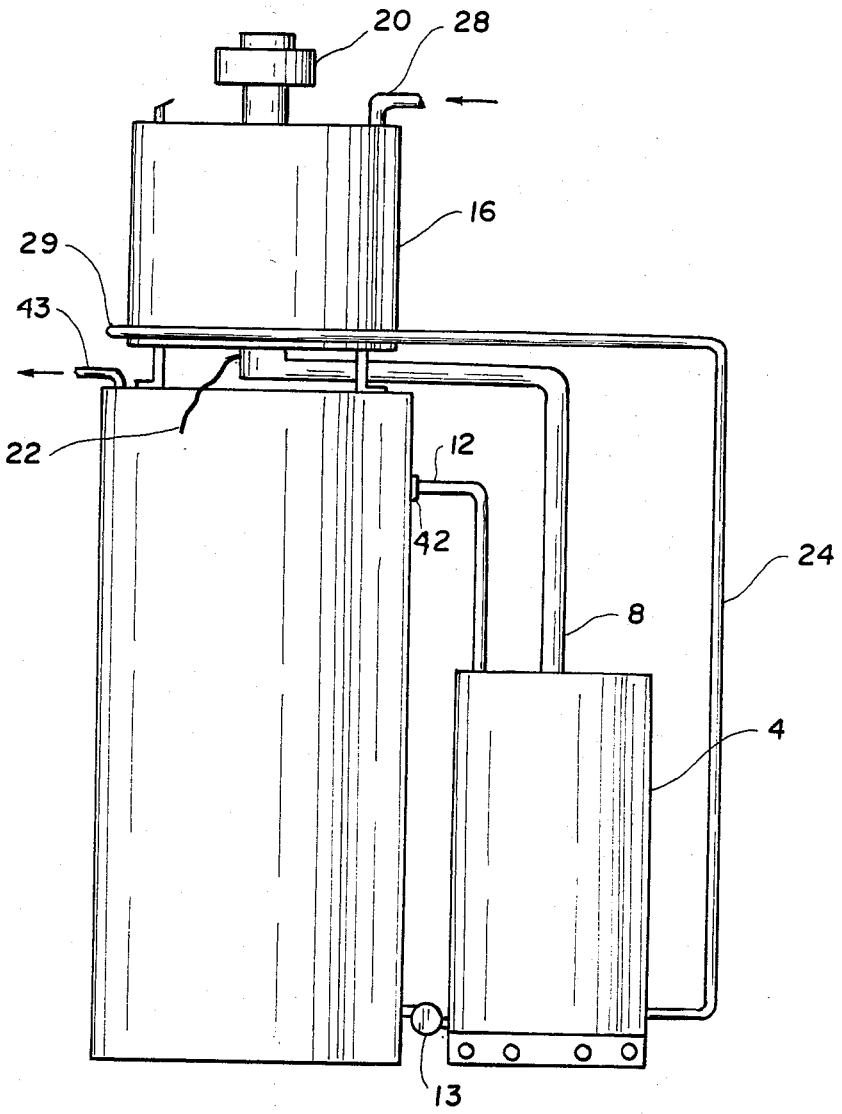
FIG. 9 is a drawing of the system of FIG. 7 with the heat trap in place on the top of the storage tank 1.
Figure 10:
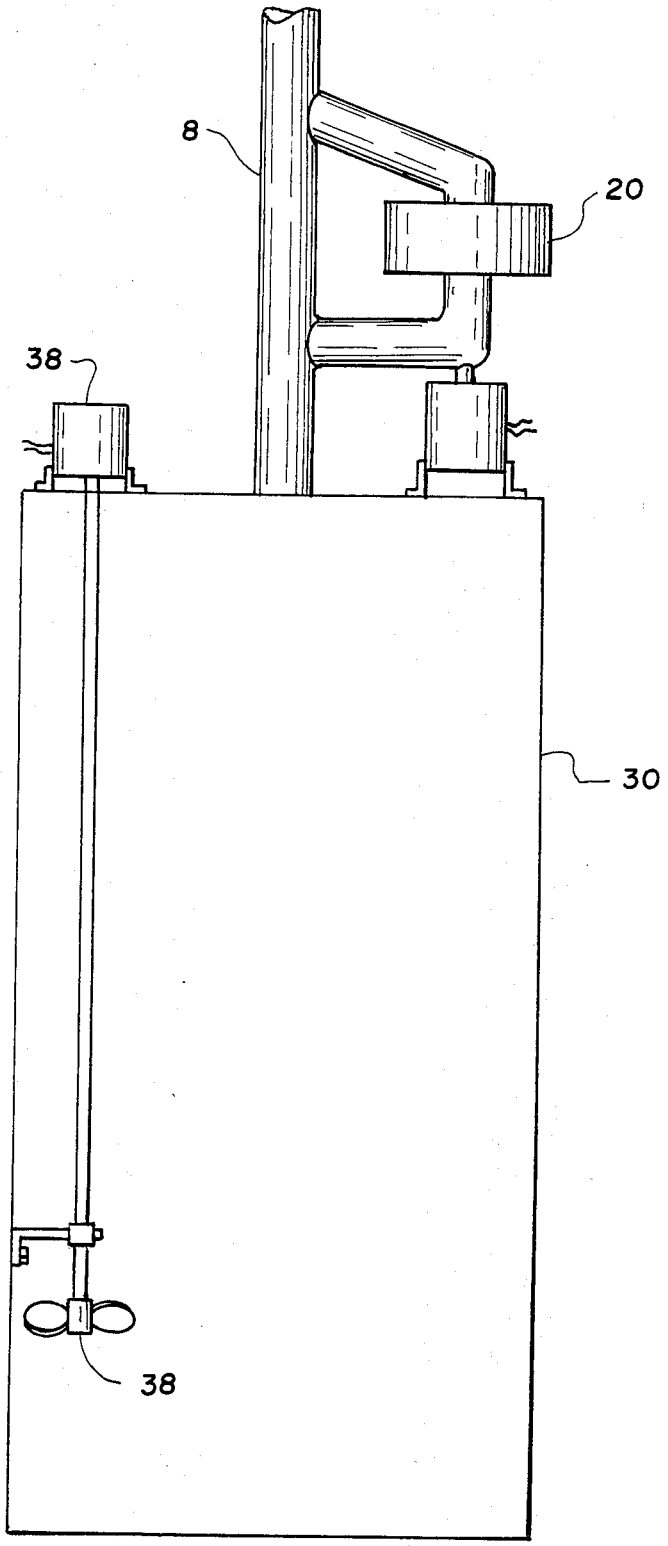
FIG. 10 shows the incorporation of an agitator 38 for the heat storage tank described in FIG. 1.

FIG. 7 is a side elevation, partly in vertical section, of a storage tank 1 having an inlet 42 and an outlet 43. To the side of, and separate from, the storage tank is a smaller tank which is similar to that in FIG. 1 having heating unit 4, said unit 4 having multiple flame tubes 5 and companion heat tubes 6 all of which culminate in a common gallery 7 and, finally, into a common flue 8. Under each of the flame tubes 5 is a gas burner jet 9 which is supplied from a conventional and safety unit 10. The heat source may be natural gas, propane, oil, or other suitable fuel. Take note that there is no burner jet under the heat tubes 6.

The heating unit 4 has a cold water inlet 11 at its bottom and a hot water exit pipe 12 which communicates with storage tank 1 at the inlet 42.

Between the storage tank 1 and the heating unit 4, is a water pump 13 which forces water at a constant rate from the storage tank 1 to the bottom of the heating unit 4, thus producing a circulating flow of water from the storage tank 1 through the pump 13 to the bottom of the heating unit 4 and thence to the upper part of the storage tank 1.

The purpose of this design is to provide maximum heat transfer and efficiency. This is accomplished by the same reasons as indicated in the description of FIG. 1. In addition, however, there are other advantages. First, since the heating unit 4 is separate from the storage tank 1, the storage tank 1 can be totally insulated to minimize heat loss during storage and "non peak" periods of minimum water usage. Secondly, the pump provides a constant flow of water over flame tubes 5 and heat tubes 6 during operation to maximize heat transfer between the water and hot flue gases. Lastly, constant circulation minimizes potential build-up of mineral type deposits on the bottom of the tank as normally found in conventional electric and (or) gas fired water heaters.

The overlapping lip design **31*a* for the heat tubes 6 and flame tubes shown in FIG. 1 may be used instead of the design shown in FIG. 7**.

FIG. 7 illustrates consumer benefits in that segregated components may be replaced upon failure in lieu of replacing whole systems as in conventional gas fired, or even electric, water heaters.

Modifications may be made of the construction shown in FIG. 1 to permit the heat tubes 6 to only connect to the flame tubes 5 and not fully extend vertically to culminate into the gallery 7. This may be done by closing off the heat tubes 6 at dotted line **6*a* as shown in FIG. 1. This design still allows any heat generated around the heat source to be captured and flow up through flame tubes 5** as well as still providing an outlet drain for possible condensation away from flames.

While I have illustrated and described several embodiments of my invention, it will be understood that these are by way of illustration only and that various changes and modifications may be contemplated in my invention and within the scope of the following claims.

I claim:

1. In an automatic hot water heater system comprising an insulated tank having contained therein, an upwardly bowed bottom, a plurality of serpentine flame tubes extending generally vertically of the tank, a plurality of heat tubes surrounding and connected to the lower end portions of said flame tubes, said heat tubes having inlets at the periphery of said bottom, flame tube inlets extending upwardly of said bottom at a higher elevation than said heat tube inlets and connected to said flame tubes, an exhaust outlet extending through the top of said tank and connected to said serpentine flame tubes and to said heat tubes, a blower in said exhaust outlet above said tank, water inlet and outlet connections extending to the bottom and top of said tank, respectively, a fuel burner jet for heating said bottom and said flame tubes and heat tubes through all of said inlets between the bottom of said tank and said respective serpentine flame tubes and heat tubes for circulating heated air through said flame tubes and heat tubes and said exhaust outlet, thence through a chimney, whereby any condensation drained downwardly through said serpentine flame tubes will be diverted to said heat tubes away from flames of said fuel burner jet.

2. A system as recited in claim 1 together with a heat trap comprising a plurality of vertically extending serpentine heat tubes, the lower ends of which are connected to said exhaust outlet of the automatic water heater system via an exhaust inlet pipe, and the upper ends connected to a common exhaust outlet connected to said chimney.

3. A heat trap as recited in claim 2 which includes a blower in said common exhaust outlet.

4. A water heater system as recited in claim 1 together with a separate storage tank completely surrounded by insulation and having connections to the top and the bottom of said first-mentioned tank and including a circulating pump for circulating heated water into said storage tank.

* * * * *